US011493018B2

(12) United States Patent
Merrill et al.

(10) Patent No.: US 11,493,018 B2
(45) Date of Patent: Nov. 8, 2022

(54) HYDRAULIC MOTOR WITH ANTI-COGGING FEATURES

(71) Applicant: Parker-Hannifin Corporation, Cleveland, OH (US)

(72) Inventors: Kyle J. Merrill, Chuckey, TN (US); Andrea Vacca, Lafayette, IN (US); Venkata Harish Babu Manne, Lafayette, IN (US); Matteo Pellegri, Edinburgh (GB)

(73) Assignee: Parker-Hannifin Corporation, Cleveland, OH (US)

( * ) Notice: Subject to any disclaimer, the term of this patent is extended or adjusted under 35 U.S.C. 154(b) by 201 days.

(21) Appl. No.: 17/076,902

(22) Filed: Oct. 22, 2020

(65) Prior Publication Data

US 2021/0207599 A1 Jul. 8, 2021

Related U.S. Application Data

(60) Provisional application No. 62/957,071, filed on Jan. 3, 2020.

(51) Int. Cl.

| | |
|---|---|
| ***F03C 2/08*** | (2006.01) |
| ***F04C 2/10*** | (2006.01) |
| ***F04C 15/00*** | (2006.01) |

(52) U.S. Cl.

CPC ..... *F03C 2/08* (2013.01); *F04C 2/103* (2013.01); *F04C 15/0046* (2013.01); *F04C 2240/10* (2013.01); *F04C 2240/20* (2013.01); *F04C 2240/801* (2013.01)

(58) Field of Classification Search

CPC ..... F03C 2/08; F04C 2/103; F04C 15/0046; F04C 2240/10; F04C 2240/20

See application file for complete search history.

(56) References Cited

U.S. PATENT DOCUMENTS

| | | | | |
|---|---|---|---|---|
| 5,030,072 | A | 7/1991 | Wenker | |
| 8,308,464 | B2 * | 11/2012 | Yoshimura | F04C 18/16 384/118 |
| 8,491,288 | B2 | 7/2013 | Lyons et al. | |

(Continued)

FOREIGN PATENT DOCUMENTS

| | | |
|---|---|---|
| EP | 0 276 680 | 1/1991 |
| EP | 1 158 165 | 11/2001 |

*Primary Examiner* — Mary Davis

(74) *Attorney, Agent, or Firm* — McDonnell Boehnen Hulbert & Berghoff LLP

(57) ABSTRACT

An example hydraulic motor comprises: a stator comprising (i) a stator body having plurality of roller pockets, wherein the stator body comprises a plurality of grooves that are longitudinally-extending, and (ii) a plurality of rollers disposed respectively in the plurality of roller pockets; a rotor having a plurality of external teeth configured to engage with the plurality of rollers of the stator, such that the plurality of rollers and the plurality of external teeth define fluid chambers therebetween configured to expand and contract as the rotor rotates within the stator; and an anti-cogging passage configured to provide pressurized fluid from at least one of the fluid chambers to at least one groove of the plurality of grooves of the stator body, such that pressurized fluid provided to the at least one groove applies a radially-inward force on a respective roller toward the rotor.

20 Claims, 8 Drawing Sheets

(56) References Cited

U.S. PATENT DOCUMENTS

| | | | | |
|---|---|---|---|---|
| 9,103,211 | B2 * | 8/2015 | White, Jr. ..... | F01C 21/106 |
| 9,388,810 | B2 * | 7/2016 | Crotti ..... | F04C 27/009 |
| 2003/0070429 | A1 | 4/2003 | Jolliff et al. | |
| 2013/0205763 | A1 | 8/2013 | Caldwell et al. | |

* cited by examiner

HYDRAULIC MOTOR WITH ANTI-COGGING FEATURES

CROSS REFERENCE TO RELATED APPLICATION

The present application claims priority to U.S. Provisional patent application no. 62/957,071 filed on Jan. 3, 2020, and entitled "Hydraulic Motor with Anti-Cogging Features," the entire contents of which are herein incorporated by reference as if fully set forth in this description.

BACKGROUND

Geroller hydraulic motors are hydraulic actuators configured to receive pressurized fluid as an input and provide high torque rotational movement as an output. Such hydraulic motors can include gear sets configured to cooperatively define fluid chambers. The chambers expand when hydraulically connected to a source (e.g., a pump) of pressurized fluid and contract when connected to a drain that returns the fluid to the source. The expansion and contraction of the fluid chambers causes the rotational movement.

Conventional geroller hydraulic motors can exhibit cogging at relatively low speeds. Cogging can be defined as a jerking or detenting (e.g., variation in the rotational output speed, pressure levels, and torque of the hydraulic motor). Geroller hydraulic motors may tend to exhibit some amount of cogging at low operating speeds as a gear in one of the gear sets rotates into mating alignment with a gear in the other gear set and hydraulic fluid passages connected to the fluid chambers are opened and closed. Cogging can result, for example, from dimensional tolerances in the hydraulic motor. Cogging can be felt by operators of machines that include such hydraulic motors and may be undesirable.

It may thus be desirable to have a geroller motor with anti-cogging features that reduce or eliminate cogging. It is with respect to these and other considerations that the disclosure made herein is presented.

SUMMARY

The present disclosure describes implementations that relate to a hydraulic motor with anti-cogging features.

In a first example implementation, the present disclosure describes a hydraulic motor. The hydraulic motor comprises: (i) a stator comprising (a) a stator body having a central opening and a plurality of roller pockets defined by an interior surface of the stator body, wherein the stator body comprises a plurality of grooves that are longitudinally-extending, and (b) a plurality of rollers disposed respectively in the plurality of roller pockets, wherein each roller of the plurality of rollers comprises a cylindrical exterior surface; (ii) a rotor disposed within the central opening of the stator body, wherein the rotor comprises a plurality of external teeth configured to engage with the plurality of rollers of the stator, such that the plurality of rollers and the plurality of external teeth define fluid chambers therebetween configured to expand and contract as the rotor rotates within the stator; and (iii) an anti-cogging passage configured to provide pressurized fluid from at least one of the fluid chambers to at least one groove of the plurality of grooves of the stator body, such that pressurized fluid provided to the at least one groove applies a radially-inward force on the cylindrical exterior surface of a respective roller toward the rotor.

In a second example implementation, the present disclosure describes a rotor set assembly of a hydraulic motor. The rotor set assembly comprises: (i) a stator comprising (a) a stator body having a central opening and a plurality of roller pockets defined by an interior surface of the stator body, and (b) a plurality of rollers disposed respectively in the plurality of roller pockets, wherein each roller of the plurality of rollers comprises a cylindrical exterior surface; (ii) a plurality of grooves that are longitudinally-extending and disposed in respective portions of the stator body that bound the plurality of roller pockets; and (iii) a rotor disposed within the central opening of the stator body, wherein the rotor comprises a plurality of external teeth configured to engage with the plurality of rollers of the stator, such that the plurality of rollers and the plurality of external teeth define fluid chambers therebetween configured to expand and contract as the rotor rotates within the stator. As the rotor rotates within the stator, at least one groove receives pressurized fluid from a fluid chamber of the fluid chambers, and the pressurized fluid in the at least one groove applies a radially-inward force on the cylindrical exterior surface of a respective roller of the plurality of rollers toward the rotor so as to maintain contact between the respective roller and the rotor.

In a third example implementation, the present disclosure describes hydraulic transmission. The hydraulic transmission comprises a pump configured to provide pressurized fluid, and a geroller hydraulic motor fluidly coupled to the pump and configured to receive pressurized fluid therefrom and provide return fluid thereto. The geroller hydraulic motor comprises: (i) a stator comprising (a) a stator body having a central opening and a plurality of roller pockets defined by an interior surface of the stator body, wherein the stator body comprises a plurality of grooves that are longitudinally-extending and disposed in respective portions of the stator body that bound the plurality of roller pockets, and (b) a plurality of rollers disposed respectively in the plurality of roller pockets, wherein each roller of the plurality of rollers comprises a cylindrical exterior surface; (ii) a rotor disposed within the central opening of the stator body, wherein the rotor comprises a plurality of external teeth configured to engage with the plurality of rollers of the stator, such that the plurality of rollers and the plurality of external teeth define fluid chambers therebetween, wherein, as the rotor rotates within the stator, a first subset of fluid chambers are configured to expand as the first subset of fluid chambers receive pressurized fluid from the pump, whereas a second subset of fluid chambers are configured to contract as the return fluid exits the second subset of fluid chambers; and (iii) an anti-cogging passage configured to provide pressurized fluid from at least one of the first subset of fluid chambers to at least one groove of the plurality of grooves, such that pressurized fluid provided to the at least one groove applies a radially-inward force on the cylindrical exterior surface of a respective roller toward the rotor.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

Figure 1:
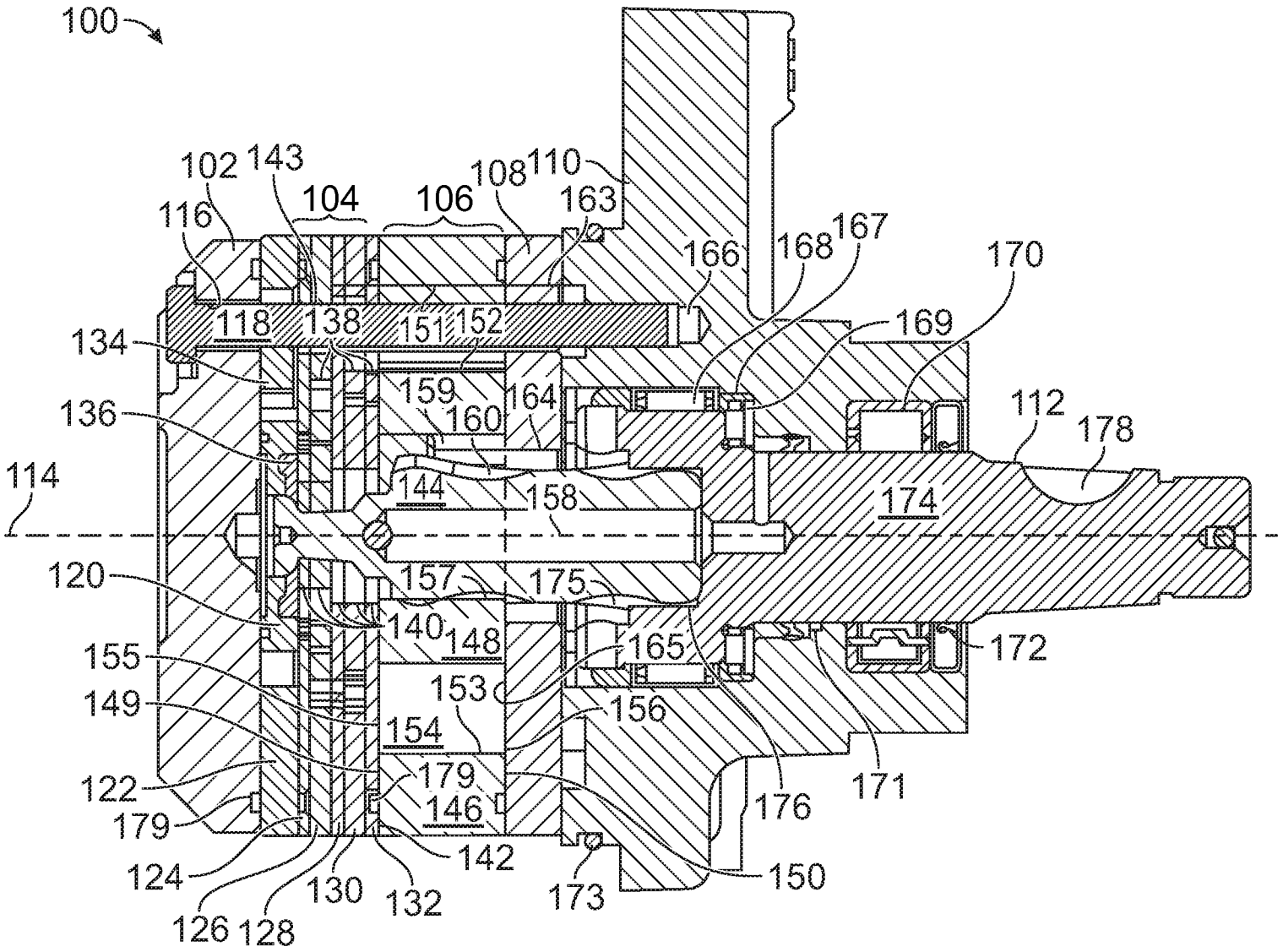
FIG. 1 illustrates a cross-sectional side view of a geroller hydraulic motor, in accordance with an example implementation.

Geroller hydraulic motors can exhibit cogging at relatively low speeds. Cogging is a jerking or detenting or variation in the rotational output speed of the hydraulic motor that (i) occurs during each complete (360 degree) rotation of the motor output shaft, (ii) at a frequency measured in cogs per revolution that is related to the number of teeth in the geroller gear set in the hydraulic motor drive assembly, and (iii) is accompanied by measurable pressure variations in the input to the hydraulic motor and torque ripple at the output of the motor. Geroller hydraulic motors may tend to exhibit some amount of cogging at low operating speeds as a gear in one of the gear sets rotates into mating alignment with a gear in the other gear set and hydraulic fluid passages connected to the fluid chambers are opened and closed. Cogging can result from dimensional tolerances in the hydraulic motor, for example.

Cogging may be undesirable in some applications. In such applications, an operator of the equipment driven by the geroller hydraulic motor may notice the cogging under specific operating conditions, and may prefer that the cogging be eliminated or reduced in order to improve performance of the hydraulic motor and of the equipment in which the hydraulic motor is used under those operating conditions.

An example application of geroller hydraulic motors in which cogging at low speed can be undesirable involves lawn mowers. Geroller hydraulic motors can be used in a lawn mower to control the mower's drive wheels. The drive wheels are rotated by the hydraulic motor to propel the vehicle. In that use, a variable displacement hydraulic pump can be used to provide the pressurized fluid input to control the geroller hydraulic motor. One pump and one hydraulic motor can be associated with each of the drive wheels of the equipment. The human operator can use control levers that separately control the output displacement of each of the variable displacement pumps, so that the rotational speed and rotational direction of each hydraulic motor, and the rotational speed and rotational direction of each drive wheel rotated by that motor, is controlled. Because each pump and motor associated with each drive wheel is separately controlled, the human operator can control forward and reverse speed and turning of the equipment.

It may be desirable under some operating conditions to operate the mower at low speeds. For instance, when the mower is being loaded to a truck for transportation, the mower can be driven up a ramp at low speed with high torque that involves high fluid pressures. Low rotational speed of a geroller hydraulic motor can for example indicate less than five revolutions per minute of the output shaft of the motor, and high fluid pressure can involve pressure levels that are greater than 900 pounds per square inch (psi) at an inlet port of the motor. Under these operating conditions, cogging of the hydraulic motors can occur and it may be undesirable.

Disclosed herein are systems, assemblies, geroller hydraulic motors, and method associated with geroller motors with anti-cogging features. These features may reduce or eliminate the likelihood that cogging may occur during operation.

Figure 2:
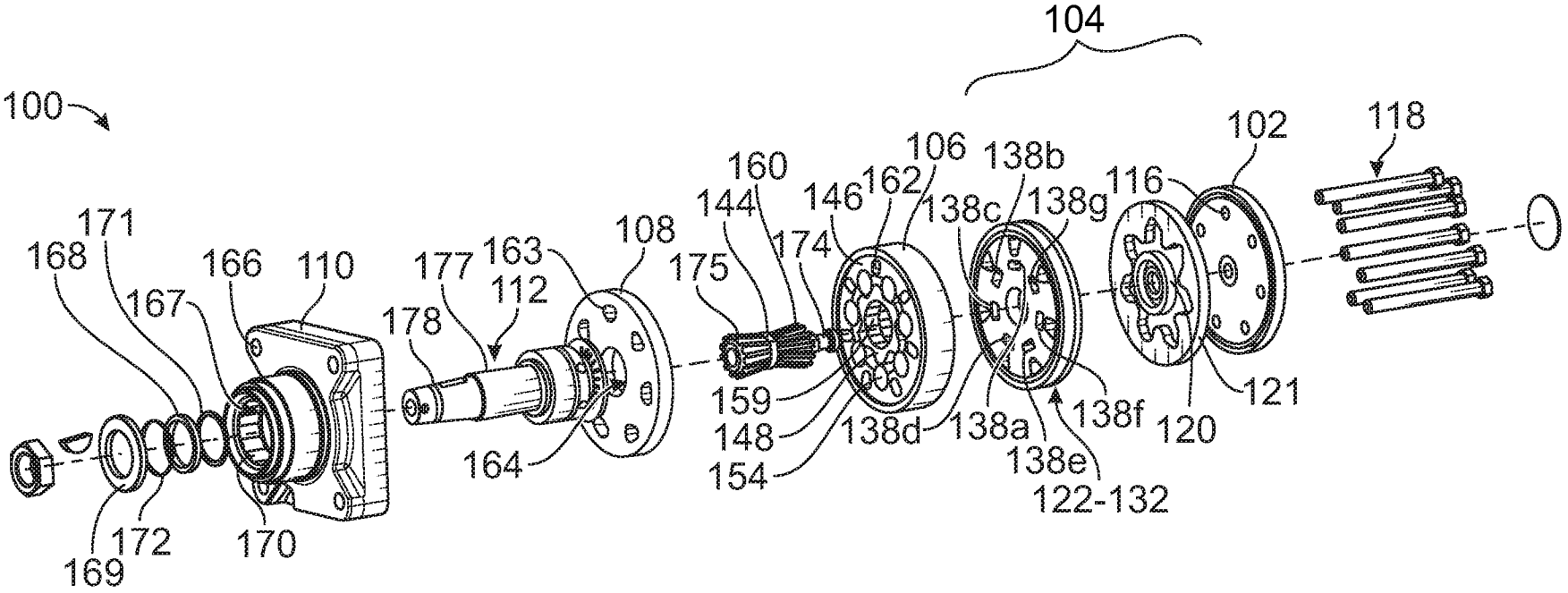
FIG. 2 illustrates an exploded perspective view of the geroller hydraulic motor of FIG. 1, in accordance with an example implementation.

FIG. 1 illustrates a cross-sectional side view of a geroller hydraulic motor 100, and FIG. 2 illustrates an exploded perspective view of the geroller hydraulic motor 100, in accordance with an example implementation. The geroller hydraulic motor 100 includes an end plate 102, a manifold 104, a rotor set assembly 106, a wear plate 108, a housing 110, an output assembly 112, and a longitudinal axis 114. The end plate 102, the manifold 104, the rotor set assembly 106, the wear plate 108, the housing 110, and the output assembly 112 can each be generally cylindrical as shown in FIG. 2.

Although the components of the geroller hydraulic motor 100 are depicted as being separate components, in other implementations, some of these components can be integral with one another. Further, the geroller hydraulic motor 100 can be a separate structure from other hydraulic components in a hydraulic circuit in which it is used, or it can be integral with and in a common housing with other components in a hydraulic circuit, or it can be bolted to such other components. For example, the geroller hydraulic motor 100 can be bolted to a hydraulic pump or can be integrated with a hydraulic pump with a common housing. The motor and pump assembly can be referred to as a hydraulic transmission.

The geroller hydraulic motor 100 is driven in a rotational direction around its longitudinal axis 114 by pressurized fluid from the hydraulic pump in a forward direction or in a reverse direction. In an example, the geroller hydraulic motor 100 is configured such that its forward direction is counter-clockwise when viewed in a longitudinal direction from its right end from the perspective of FIG. 1 looking toward its left end. When the terms counter-clockwise and clockwise are used herein, it is with reference to viewing the geroller hydraulic motor 100 in such longitudinal direction. The reverse direction of the geroller hydraulic motor 100 is clockwise. The operation of the geroller hydraulic motor 100 is described below in the forward direction, and the reverse rotational direction of the geroller hydraulic motor 100 can be achieved by reversing the flow of hydraulic fluid through the geroller hydraulic motor 100.

The end plate 102 of the geroller hydraulic motor 100 includes a plurality of end plate bolt holes, such as hole 116, configured to receive threaded bolts 118. The bolts 118 secure the end plate 102, the manifold 104, the rotor set assembly 106, the wear plate 108, and the housing 110 together.

The manifold 104 includes a commutator 120 that is rotatable and disposed within a commutator ring 121 that is stationary. The manifold 104 also includes manifold plates 122, 124, 126, 128, 130, and 132 configured to be stationary plates. The commutator 120 is configured to separate an inlet chamber 134 from an outlet chamber 136 shown in FIG. 1. The geroller hydraulic motor 100 can be bi-directional, and thus the inlet chamber 134 can operate as an outlet chamber, while the outlet chamber 136 can operate as an inlet chamber.

The manifold plates 122-132 can each include a plurality of fluid flow passages 138 (including fluid flow passages 138*a*, 138*b*, 138*c*, 138*d*, 138*e*, 138*f*, and 138*g*) and fluid passages 140 that extend through the manifold plates 122-132. The fluid flow passages 138 can be referred to as openings or windows and can be configured to terminate at an end face 142 of the manifold plate 132 at fluid flow passages 138*a*-138*g*, as further described below. The manifold plates 122-132 each also include respective seven bolt holes 143 for receiving the bolts 118 and for providing a fluid flow path.

The commutator 120 is configured to be driven by a drive link 144 that can be considered part of the output assembly 112. The rotor set assembly 106, the output assembly 112, and the drive link 144 can collectively be referred to as a drive assembly. The commutator 120 is moved by the drive link 144 in an orbital path relative to the manifold plates 122-132 to open and close fluid communication between the inlet chamber 134 and the fluid flow passages 138 and also between the outlet chamber 136 and the fluid flow passages 138. The fluid flow passages 138 of the manifold 104 are configured to supply higher pressure pressurized hydraulic fluid from the inlet chamber 134 to, and receive lower pressure return hydraulic fluid from, the rotor set assembly 106 to cause rotation of the geroller hydraulic motor 100 in the forward direction as also further described below. The end face 142 of the manifold plate 132 of the manifold 104 is disposed in a plane perpendicular to the longitudinal axis 114.

The rotor set assembly 106 includes a stator 146 and a rotor 148. The rotor 148 is configured to be rotatably disposed within an inner space or central opening of a stator body of the stator 146. The stator 146 and the rotor 148 each includes an end face 149 that engages or interfaces with the end face 142 of the manifold plate 132 of the manifold 104. The stator 146 and the rotor 148 each also include another end face 150 that is parallel to the end face 149 and engages or interfaces with the wear plate 108.

The stator 146 can include a stator body having respective bolt holes such as hole 151 shown in FIG. 1, for receiving the bolts 118. The stator body of the stator 146 also includes a central opening 152 that is longitudinally-extending along the longitudinal axis 114. The central opening 152 is generally circular in lateral cross section.

As illustrated in FIG. 2, the central opening 152 of the stator body provides multiple (e.g., seven in FIG. 2) roller cavities or roller pockets 153 configured as semi-circular longitudinally-extending pockets and disposed in a radial array about interior surface of the stator body. Each of the roller pockets 153 is configured to receive a longitudinally-extending cylindrical roller, such as roller 154. Throughout this disclosure, the rollers can be referred to in the singular as the roller 154 to refer to a particular roller or in the plural as rollers 154 to collectively refer to the rollers of the stator 146. The rollers 154 can be configured to rotate freely in their respective roller pockets. The rollers 154 can also be referred to as vanes or vane rollers.

The rollers 154 each include a cylindrical exterior surface between end face 155 and end face 156 as shown in FIG. 1. The rollers 154 are configured to operate as internal gear teeth of the stator 146 formed within the central opening 152, and provide an internal gear set for the rotor set assembly 106.

Referring to FIGS. 1 and 2, the rotor 148 includes a longitudinally-extending central opening 157 and a longitudinal axis 158. The longitudinal axis 158 is parallel to, and radially-spaced or radially-offset from, the longitudinal axis 114 of the stator 146. The surface of the longitudinally-extending central opening 157 of the rotor 148 is generally circular in lateral cross section and has a plurality of splines 159 for mating with corresponding external splines 160 located on the drive link 144.

The exterior surface of the rotor 148 defines a plurality of external teeth 162 (e.g., protrusions similar to gear teeth) shown in FIG. 2 configured to interact with the rollers 154 of the stator 146. The number of external teeth 162 on the rotor 148 can be one less than the number of rollers 154 of the stator 146. The external teeth 162 operate as external gear set that meshes with the rollers 154 that operate as internal gear teeth as the rotor 148 rotates and orbits relative to the stator 146. In the forward direction of the geroller hydraulic motor 100, the rotor 148 and the drive link 144 both rotate in the counter-clockwise direction and the rotor 148 and the commutator 120 both orbit in the clockwise direction due to interaction between the external teeth 162 of the rotor 148 and the rollers 154.

The wear plate 108 includes bolt holes 163 for receiving the bolts 118. The wear plate 108 includes a central opening 164 that is longitudinally-extending along the longitudinal axis 114. The wear plate 108 also includes an end face 165 that is parallel to, and engages or interfaces with, the end faces 150 of the stator 146 and the rotor 148.

The housing 110 includes blind threaded bolt holes 166 configured to receive the threaded ends of the bolts 118. The housing 110 also includes a central opening 167 arranged along the longitudinal axis 114.

The central opening 167 is stepped to receive suitable bearings such as bearing 168, bearing 169, and bearing 170 for supporting the output assembly 112. The central opening 167 also carries suitable seals such as seal 171 and seal 172 for precluding egress or leakage of hydraulic fluid and ingress of dirt and other foreign materials into the central opening 167. An external groove on the exterior surface of the housing 110 is configured to receive a seal 173 that seals against a surface of a hydraulic pump to which the geroller hydraulic motor 100 can be coupled.

The drive link 144 includes a commutator drive extension 174 configured to be received in a corresponding central opening in the commutator 120 to drive the commutator 120 in a clockwise orbital path relative to the manifold 104. The drive link 144 also includes splines 175 that mesh with splines 176 formed on an exterior surface of an output shaft 177 of the output assembly 112.

The drive link 144 is configured to be driven by engagement of the splines 159 of the rotor 148 with the splines 160 of the drive link 144. The central region of the drive link 144 is supported in the central opening 164 of the wear plate 108 to permit rotational and rocking movement of the drive link 144 relative to the wear plate 108.

The splines 160 and the splines 175 of the drive link 144 can transmit torque from the rotor 148 through the drive link 144 to the output shaft 177. In this manner, energy from the pressurized fluid that drives the rotor 148 is transmitted to the output shaft 177. A key slot 178 formed on the exterior surface of the output shaft 177 is configured to connect the output shaft 177 to the device that is to be driven by the geroller hydraulic motor 100 (e.g., to a wheel of a lawn mower).

Generally circular longitudinally facing grooves 179 extend around the end faces of the end plate 102 and the manifold 104 to receive generally circular seals. Such seals can prevent leakage between the end plate 102 and the manifold 104 and between the manifold 104 and the rotor set assembly 106.

Figure 3:
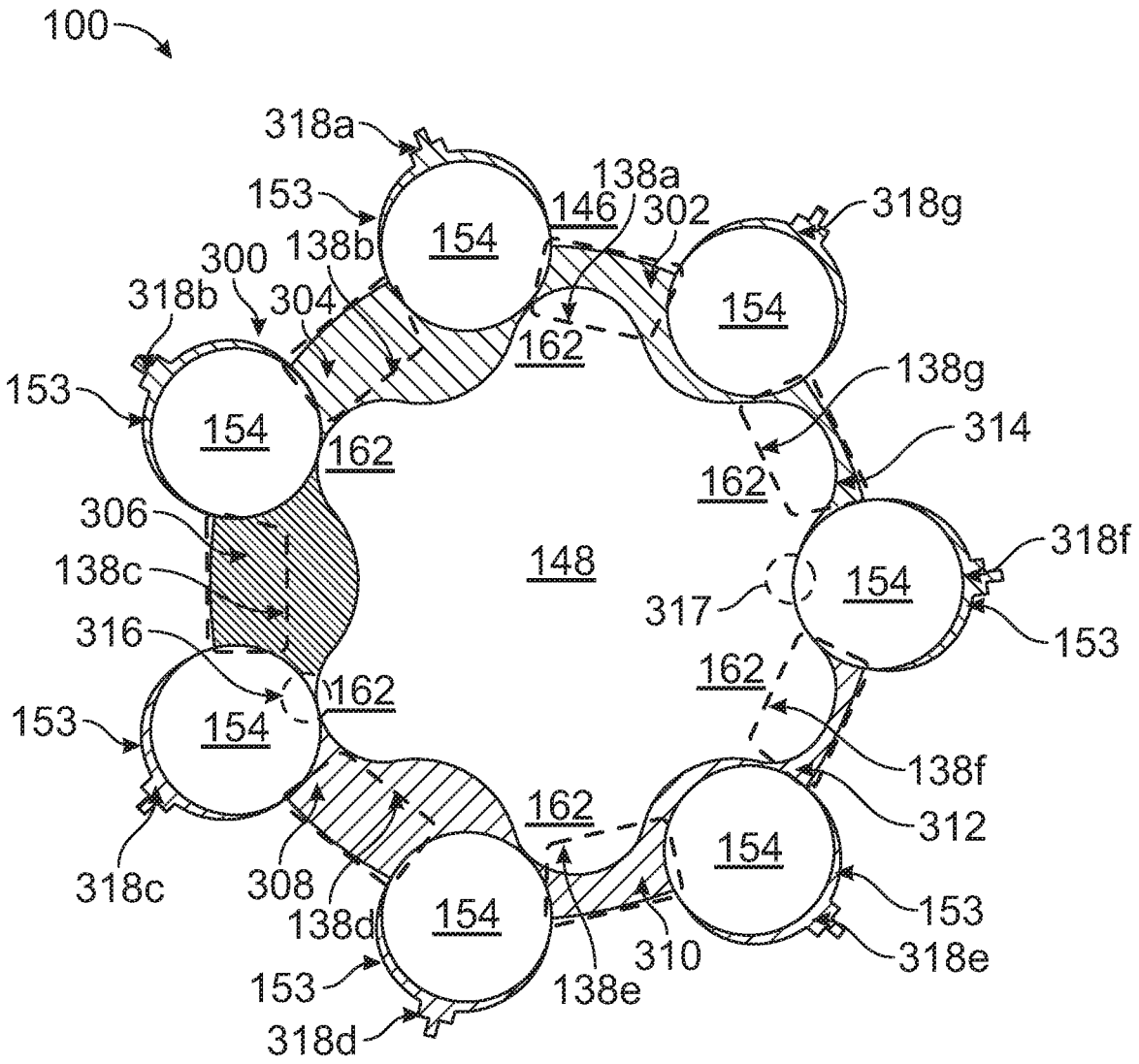
FIG. 3 illustrates a schematic partial lateral view of a rotor set assembly with fluid flow passages superimposed thereon, in accordance with another example implementation.

FIG. 3 illustrates a schematic partial lateral view of the rotor set assembly 106 with the fluid flow passages 138 superimposed or projected thereon, in accordance with an example implementation. Although not shown in the schematic view of FIG. 3, the rotor 148 includes the longitudinally-extending central opening 157 and has the splines 159 described above. Also, fluid is depicted in FIG. 3 with cross-hatching.

As depicted in FIG. 3, the stator 146 includes a stator body 300 configured to have or defines the roller pockets 153 on an interior surface of the stator body 300, and the roller pockets 153 receive the rollers 154 therein. The rollers 154 of the stator 146 and the external teeth 162 of the rotor 148 effectively engage and cooperatively define respective fluid chambers such as fluid chambers 302, 304, 306, 308, 310, 312, and 314, in the rotor set assembly 106. The fluid chambers 302-314 are separated from one another by effective moving contact between the external teeth 162 and the rollers 154.

As the rotor 148 rotates and orbits within the stator 146, the fluid chambers 302-314 each expand and contract. The fluid chambers 302-314 can include a portion of, and are fluidly coupled to, the adjacent fluid flow passage of the fluid flow passages 138*a*-138*g*. This way, the fluid chambers 302-314 can have substantially the same pressure level of fluid as the pressure level of fluid in the corresponding or adjacent fluid flow passage of the fluid flow passages 138*a*-138*g*.

As an example to illustrate operation of the geroller hydraulic motor 100, the rotary and orbital movement of the rotor 148 can be caused by pressurized hydraulic fluid that is directed by the commutator 120 from the inlet chamber 134 to the fluid flow passages 138*d*, 138*e*, and 138*f*. As illustrated in FIG. 3, the fluid flow passages 138*d*, 138*e*, and 138*f* are aligned with the fluid chambers 308, 310, and 312, respectively, of the rotor set assembly 106. In this case, the pressurized fluid can cause the fluid chambers 308, 310, and 312 to expand, and thus cause the rotor 148 to rotate in the counterclockwise direction.

In a similar manner, when the components of the geroller hydraulic motor 100 are in the positions illustrated in FIG. 3, lower pressure drain fluid from the fluid chambers 302, 304, 306, and 314 is directed by the commutator 120 from the fluid flow passages 138*a*, 138*b*, 138*c*, and 138*g* to the outlet chamber 136. This allows the fluid chambers 302, 304, 306, and 314 to contract.

A source of pressurized hydraulic fluid (e.g., a variable displacement hydraulic pump) can be fluidly coupled to the geroller hydraulic motor 100. Such source can supply pressurized hydraulic fluid to and receive return hydraulic fluid from, the geroller hydraulic motor 100, thereby causing the rotor 148 to rotate as described above. As the rotor 148 rotates, the drive link 144 rotates therewith due to engagement of the splines 159, 160. In turn, rotation of the drive link 144 can cause the output shaft 177 of the geroller hydraulic motor 100 to rotate due to engagement of the splines 175, 176. The output shaft 177 can be coupled to a wheel of a machine (e.g., a lawn mower), and can thus rotate the wheel to propel the machine.

An operator of the machine (e.g., an operator of the lawn mower) can use joysticks or control levers to control the displacement and pressure and direction of the fluid pressure output of the source of the fluid. This controls the speed and torque and direction of each of the geroller hydraulic motor 100 to control the speed and torque and direction of the wheel coupled thereto.

It may be desirable for the geroller hydraulic motor 100 to provide smooth torque and power output throughout the range of speeds and torques that the geroller hydraulic motor 100 is capable of generating. Particularly, under some operating conditions, the geroller hydraulic motor 100 may be operated at low speeds while generating high torque (e.g., during loading a lawn mower on a truck). Under such operating conditions, it may be desirable to preclude cogging from occurring, e.g., preclude jerking or variation in the rotational output speed, pressure levels, and torque of the geroller hydraulic motor 100.

In an example, the geroller hydraulic motor 100 may tend to exhibit some amount of cogging at low operating speeds due to dimensional tolerances during manufacturing causing a tip gap to occur between an external tooth of the external teeth 162 and a mating roller of the rollers 154. During rotation and orbiting of the rotor 148, some of the fluid chambers 302-314 can receive high pressure fluid, while the others have low pressure return. Thus, a fluid chamber on one side of the effective moving contact between one of the external teeth 162 and a roller of the rollers 154 can have higher pressure fluid compared to another fluid chamber on the other side of the effective moving contact. If a gap occurs between the external tooth of the rotor 148 and the roller of the stator 146, leakage from the fluid chamber having the higher pressure fluid may occur to the fluid chamber having the lower pressure fluid.

For example, referring to FIG. 3, a tip gap 316 or tip gap 317 may occur between the external teeth 162 and the roller 154 during rotation and orbiting of the rotor 148 within the stator 146 due to manufacturing tolerances. If the tip gap 316 exists, leakage (fluid flow at a low flow rate) can occur from the fluid chamber 308 having higher pressure fluid compared to the fluid chamber 306 having lower pressure fluid. Similarly, if the tip gap 317 exists, leakage can occur from the fluid chamber 312 having high pressure fluid to the fluid chamber 314 having low pressure fluid. Such leakage can reduce pressure level of the fluid in the fluid chamber 308 or the fluid chamber 312 and cause rotary motion of the rotor 148 to be opposed or resisted, thereby reducing torque and power output of the geroller hydraulic motor 100. In these cases, cogging may result and may be felt by the operator of the machine.

Such tip gaps (e.g., the tip gaps 316, 317) may be eliminated by tightly specifying the manufacturing tolerances of the components of the geroller hydraulic motor 100. Tightly specifying manufacturing tolerances may increase cost of the geroller hydraulic motor 100. It may thus be desirable to configure the geroller hydraulic motor 100 in a manner that eliminates occurrence of tip gaps without tight manufacturing tolerances that can increase cost.

In particular, the geroller hydraulic motor 100 can be configured to provide pressurized fluid to spaces formed between the exterior cylindrical surfaces of the rollers and an interior peripheral surface of stator body 300 of the stator 146. This way, the pressurized fluid can apply a radially-inward force on a respective roller of the rollers 154 toward the rotor 148 and eliminate or reduce the likelihood of tip gaps from occurring.

As an example, referring to FIG. 3, the rotor set assembly 106 can be configured such that the stator 146 can have longitudinally-extending channels or longitudinally-extending grooves disposed in the stator body 300 of the stator 146 such as groove 318*a*, groove 318*b*, groove 318*c*, groove 318*d*, groove 318*e*, groove 318*f*, and groove 318*g*. Particularly, the grooves 318*a*-318*g* are formed in portions of the interior peripheral surface of the stator body 300 that defines or bounds the roller pockets 153. In other words, the grooves 318*a*-318*g* are fluidly coupled to the roller pockets 153 of the stator 146. The grooves 318*a*-318*g* can be considered an extension or enlargement of the roller pockets 153 of the stator 146 in which the rollers 154 are disposed, and the roller pockets 153 are thus exposed to any fluid in the grooves 318*a*-318*g*.

The grooves 318*a*-318*g* are disposed radially outward from the respective rollers 154. With this configuration, if pressurized fluid is provided to the grooves 318*a*-318*g*, the fluid in the grooves 318*a*-318*g* applies a radially-inward force on the respective roller of the rollers 154 toward the rotor 148, thereby pressing the roller 154 against the exterior surface of the rotor 148 and eliminating any potential tip gap.

Figure 4:
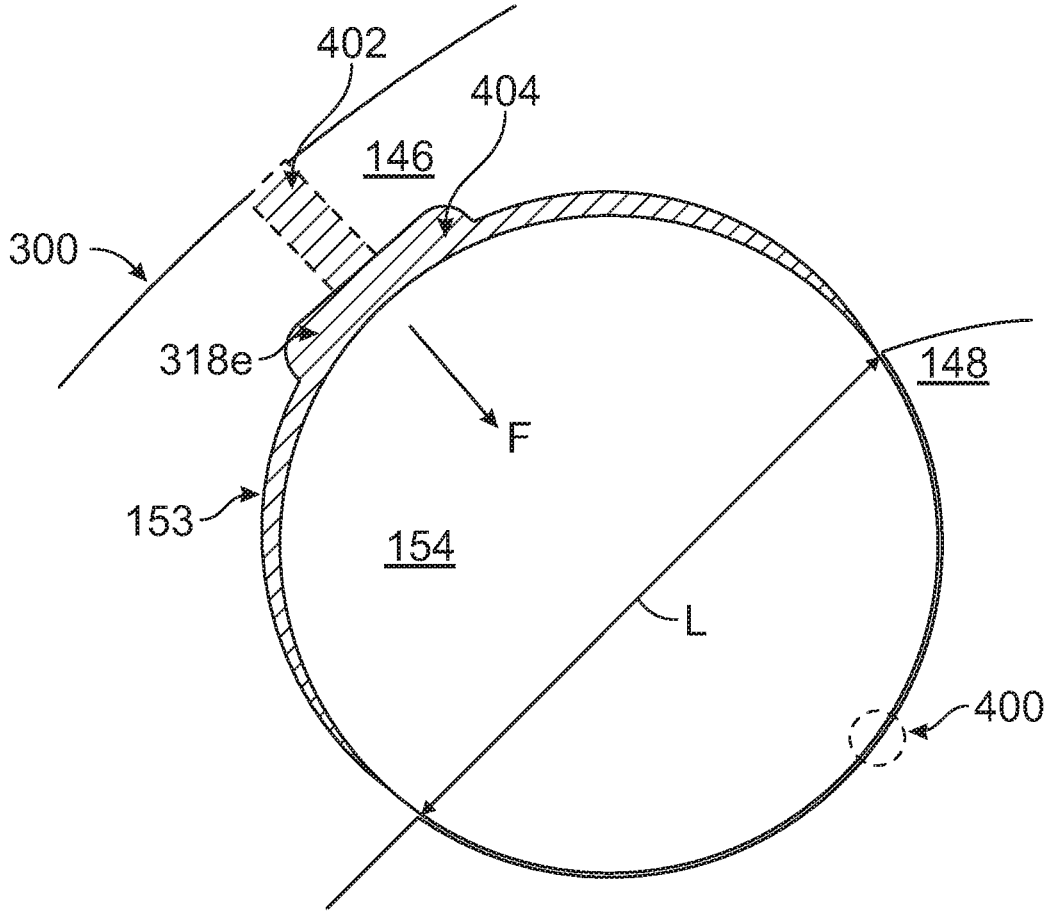
FIG. 4 illustrates a partial schematic view of the rotor set assembly of FIG. 3 depicting one roller of a plurality of rollers in a roller pocket, in accordance with an example implementation.

FIG. 4 illustrates a partial schematic view of the rotor set assembly 106 depicting one roller of the rollers 154 in one of the roller pockets 153, in accordance with an example implementation. FIG. 4 depicts a zoomed-in view of the rotor set assembly 106 with one roller of the rollers 154 shown and the corresponding groove, e.g., the groove 318*e*. However, the description related to FIG. 4 is applicable to other rollers of the rollers 154 and the corresponding groove 318*a*-318*d* and 318*f*-318*g*. Similar to FIG. 3, fluid is depicted in FIG. 4 with cross-hatching.

When pressurized fluid (e.g., high pressure fluid supplied from a source of fluid) is communicated to the groove 318*e*, the roller pocket 153 receives pressurized fluid. This way, the roller pocket 153 operates as a hydrostatic bearing for the roller 154 disposed therein. Further, the pressurized fluid applies a radially-inward force (F) on the roller 154 toward rotor 148. The force F can be estimated as F=P. L. b, where P is pressure level of fluid in the groove 318*e*, L is projection length (labelled in FIG. 4) upon which fluid acts, and b is a length of the roller 154 (depth of the roller 154 from the view of FIG. 4). It should be noted that L. b represents an exterior cylindrical surface area of the roller 154 upon which the pressurized fluid acts. As a result of the force F, the roller 154 is pushed or pressed against the exterior surface of the rotor 148, thus providing sealing therebetween. In other words, the force F might eliminate any potential tip gap at region 400.

With this configuration, leakage between adjacent fluid chambers of the fluid chambers 302-314 might be eliminated or reduced, thereby reducing the likelihood of occurrence of cogging. Additionally, manufacturing dimensional tolerances of the stator 146, the rollers 154, and the rotor 148 can be relaxed as the pressurized fluid in the grooves 318*a*-318*g* presses the rollers 154 against the rotor 148, thereby eliminating any tip gaps that might occur.

In an example implementation, the geroller hydraulic motor 100 can be configured such that all the grooves 318*a*-318*g* receive high pressure fluid continually. This way, all the rollers 154 are pressed against the rotor 148 during operation of the geroller hydraulic motor 100.

In another example implementation, high pressure or pressurized fluid can be provided to a subset of the grooves 318*a*-318*g*. Particularly, providing pressurized fluid can be timed based on rotational position of the rotor 148 and based on which fluid chambers of the fluid chambers 302-314 receives high pressure fluid. For example, referring back to FIG. 3, if the fluid chambers 308, 310, and 312 receive pressurized fluid from the fluid flow passages 138*d*, 138*e*, and 138*f*, then the pressurized fluid can be communicated to the corresponding grooves 318*c*, 318*d*, and 318*e*, while the rest of the grooves 318*a*, 318*b*, 318*f*, and 318*g* may have low pressure or drain fluid. This way, pressurized fluid is communicated to a subset of the rollers 154 that are "active," i.e., the subset of rollers 154 that is pushed against by the rotor 148 due to high pressure fluid in the corresponding fluid chambers 308, 310, and 312. As the rotor 148 rotates and different fluid chambers of the fluid chambers 302-314 receive pressurized fluid, the corresponding grooves of the grooves 318*a*-318*g* also receive the pressurized fluid. In an example, the pressurized fluid can be provided to at least one of the grooves 318*a*-318*g*, i.e., to the groove where a tip gap is most likely to occur between a corresponding roller and the rotor 148 based on the particular rotational position of the rotor 148.

The grooves 318*a*-318*g* can be configured in various ways. For example, as depicted in FIGS. 3-4, each of the grooves 318*a*-318*g* can be configured as a T-shaped groove. For instance, the groove 318*e* depicted in FIG. 4 is composed of a straight groove 402 and a slot 404, i.e., a bottom slot facing the roller 154. However, other geometric shapes such as having a semi-circular groove can be implemented.

Figure 5:
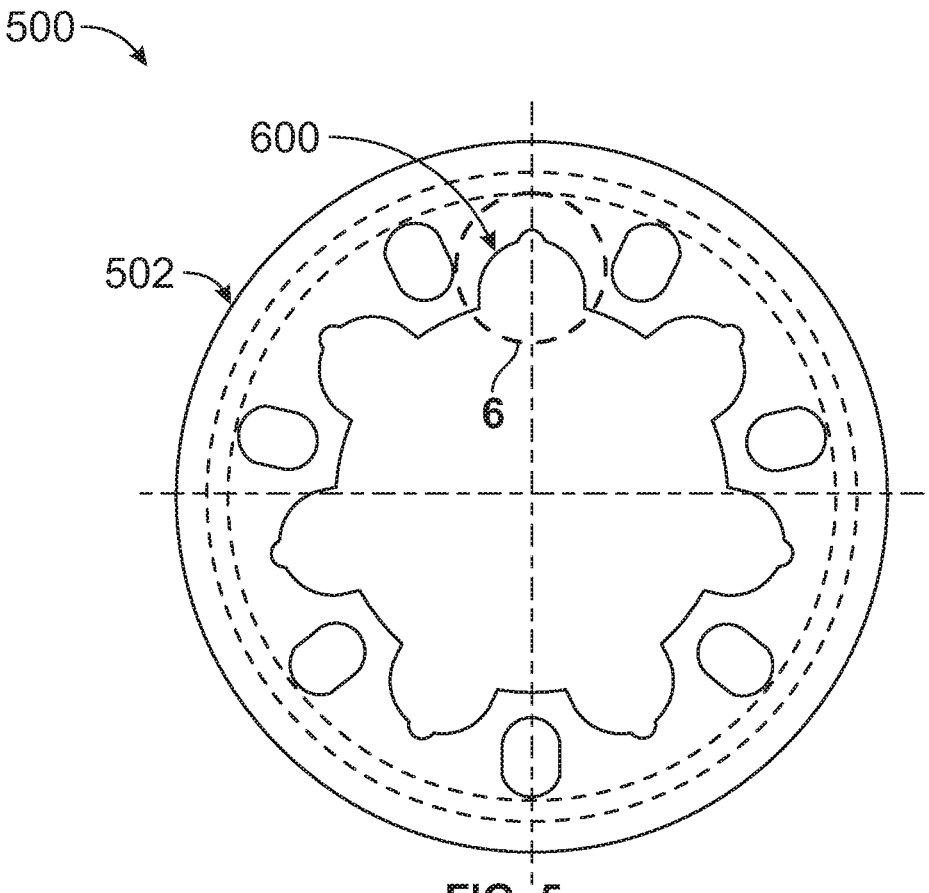
FIG. 5 illustrates a lateral view of a stator having a stator body defining a plurality of roller pockets, in accordance with an example implementation.
Figure 6:
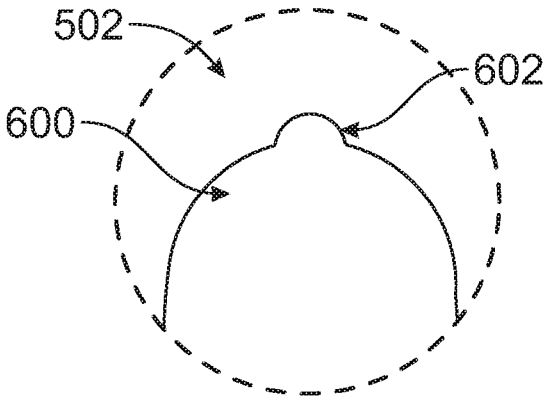
FIG. 6 illustrates a partial view of a roller pocket of the stator of FIG. 5 having a semi-circular groove, in accordance with an example implementation.

FIG. 5 illustrates a lateral or fontal view of a stator 500 having a stator body 502 defining a plurality of roller pockets with semi-circular grooves, and FIG. 6 illustrates a partial view of a roller pocket 600 of the stator 500 having a semi-circular groove 602, in accordance with an example implementation. Particularly, FIG. 6 depicts a portion of the stator 500 that is circled and labelled "6" in FIG. 5.

In the description presented herein, the roller pockets of the stator body 502 can be referred to in the singular as the roller pocket 600 to refer to a particular roller pocket or in the plural as roller pockets 600 to collectively refer to the roller pockets of the stator body 502. Similarly, the semi-circular grooves of the stator body 502 can be referred to in the singular as the semi-circular groove 602 to refer to a particular semi-circular groove or in the plural as semi-circular grooves 602 to collectively refer to the semi-circular grooves of the stator body 502.

As shown in FIGS. 5 and 6, rather than having a T-shaped groove similar to the grooves 318*a*-318*g* of FIGS. 3-4, a semi-circular groove such as the semi-circular groove 602 can be used. Similar to the grooves 318*a*-318*g*, the semi-circular groove 602 (and the other semi-circular grooves groove of the other roller pockets in the stator body 502) is formed in portions of the interior surface of the stator body 502 defining or bounding the roller pockets 600. Pressurized fluid can be provided to the semi-circular groove 602 so as to apply the radially-inward force described above on a respective roller (not shown in FIGS. 5-6) disposed in the roller pocket 600.

As shown in FIGS. 5-6, a radius of the semi-circular groove 602 is smaller than respective radius of the roller pocket 600. For example, while a radius of the stator body 502 of the stator 500 can be about 5 inches, a radius of the roller pocket 600 can be about 0.35 inches, and the radius of the semi-circular groove 602 can be about 0.095 inches. As such, different geometries can be used for the grooves that receive fluid to apply the radially-inward force on the rollers 154 toward the rotor 148.

High pressure or pressurized fluid can be provided to the grooves (e.g., the grooves 318*a*-318*g* or the semi-circular grooves 602) via anti-cogging passages disposed in the geroller hydraulic motor 100 and configured to communicate the pressurized fluid to the grooves. The anti-cogging passages can be arranged in various ways. For example, the geroller hydraulic motor 100 can provide an arrangement of a plurality of anti-cogging passages that can be disposed in the manifold 104 or the wear plate 108.

Figure 7:
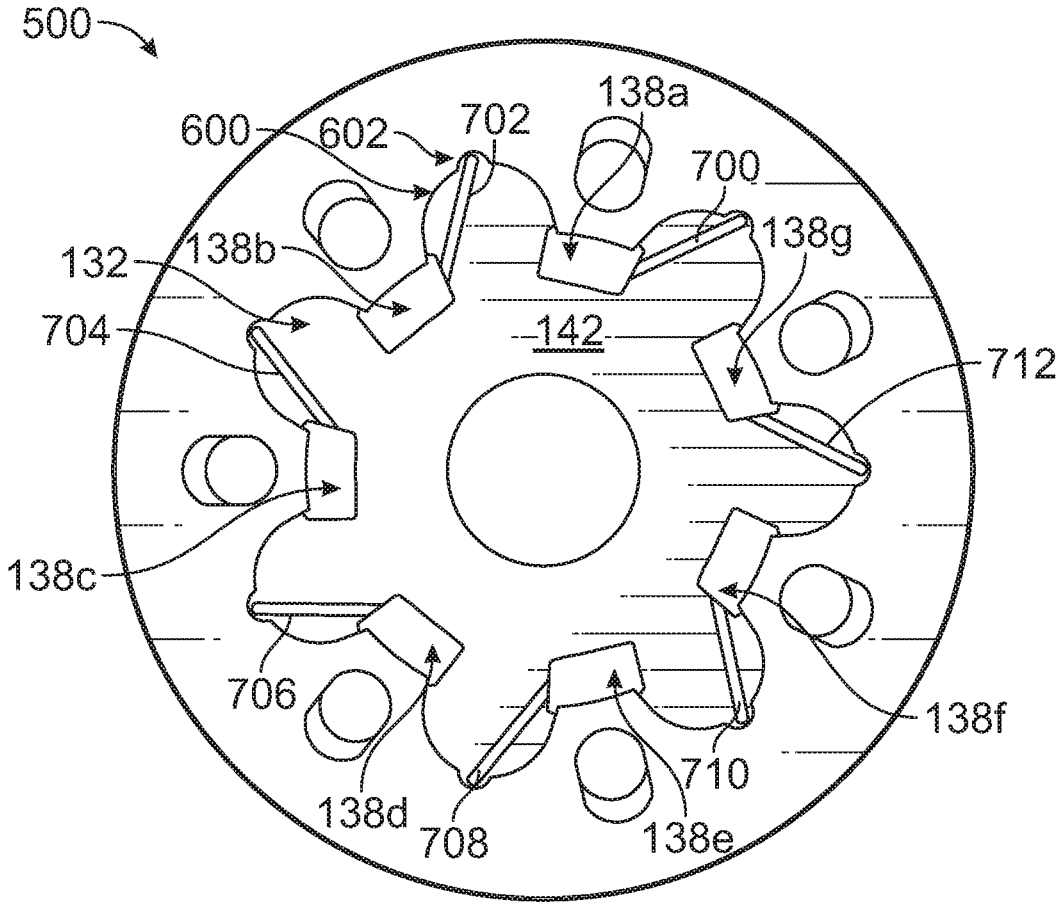
FIG. 7 illustrates a partial lateral cross-sectional view of a geroller hydraulic motor in a plane perpendicular to a longitudinal axis showing a stator and a plate of a manifold, in accordance with an example implementation.

FIG. 7 illustrates a partial lateral cross-sectional view of the geroller hydraulic motor 100 in a plane perpendicular to the longitudinal axis 114 showing the stator 500 and the manifold plate 132 of the manifold 104, in accordance with an example implementation. As show in FIG. 7 anti-cogging passages 700, 702, 704, 706, 708, 710, and 712 can be formed in the end face 142 of the manifold plate 132 of the manifold 104.

Each of the anti-cogging passages 700-712 can be in the shape of a shallow and narrow groove in the end face 142 and can be configured to extend from one of the fluid flow passages 138*a*-138*g*, respectively, to the semi-circular grooves 602, of the stator 500. As mentioned above, the fluid flow passages 138*a*-138*g* are configured to communicate pressurized fluid to the fluid chambers 302-314 to drive the rotor 148. In examples, dimensions of the anti-cogging passages 700-712 can be sufficiently small as to preclude any substantial leakage from the fluid chambers 302-314 through the anti-cogging passages 700-702 but are sufficiently large as to substantially communicate fluid having the pressure level of fluid in the fluid chambers 302-314 and the fluid flow passages 138*a*-138*g* to the grooves (the grooves 318*a*-318*g* or the semi-circular grooves 602).

Thus, the anti-cogging passages 700-712 can be disposed in the end face 142 of the manifold plate 132 of the manifold 104 adjacent the stator 146 and rotor 148. Additionally or alternative, anti-cogging passages can be disposed at another location or locations that substantially communicate the pressure level in the fluid chambers 302-314 and the fluid flow passages 138*a*-138*g* to the grooves (e.g., the grooves 318*a*-318*g* or the semi-circular grooves 602) without causing substantial leakage.

Figure 8:
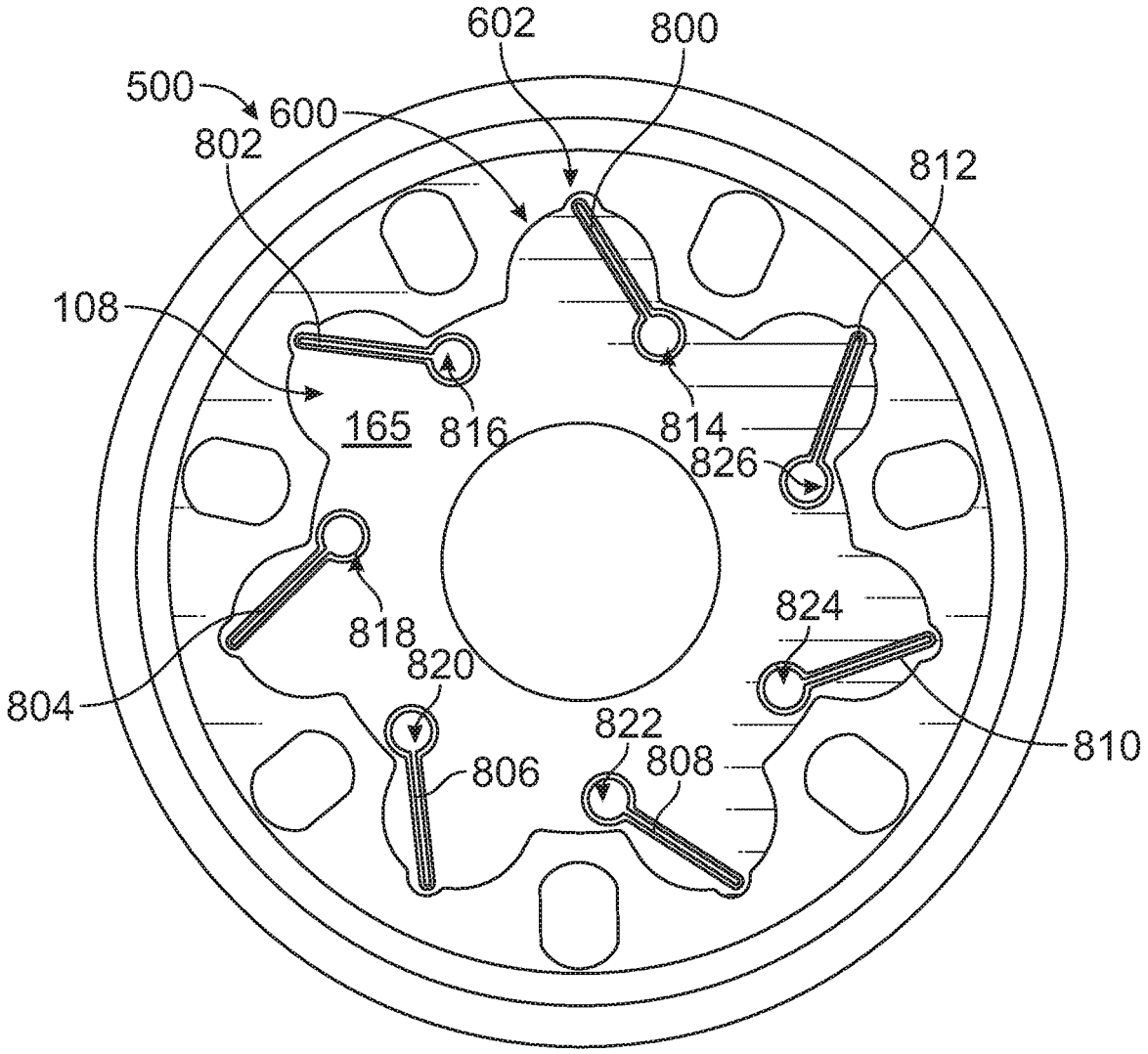
FIG. 8 illustrates a partial lateral cross-sectional view of a geroller hydraulic motor in a plane perpendicular to a longitudinal axis showing a stator and a wear plate, in accordance with an example implementation.

FIG. 8 illustrates a partial lateral cross-sectional view of the geroller hydraulic motor 100 in a plane perpendicular to the longitudinal axis 114 showing the stator 500 and the wear plate 108, in accordance with an example implementation. As show in FIG. 8 anti-cogging passages 800, 802, 804, 806, 808, 810, and 812 can be formed in the end face 165 of the wear plate 108.

Each of the anti-cogging passages 800-812 can be formed as a shallow groove in the end face 165 of the wear plate 108 and can have a size and shape substantially the same as the size and shape of each of the anti-cogging passages 700-712 described above. The end face 165 of the wear plate 108 can also include a plurality of supply passages 814, 816, 818, 820, 822, 824, and 826 that are fluidly coupled to and configured to communicated fluid to the anti-cogging passages 800-812, respectively. The supply passages 814-826 can also be referred to as supply grooves or holes and can be configured to be blind holes formed in the wear plate 108.

The supply passages 814-826 are also configured to be fluidly coupled to the fluid chambers 302-314, which are fluidly coupled to the fluid flow passages 138*a*-138*g*, respectively. The supply passages 814-826 are each sufficiently large to communicate substantially the full unrestricted fluid pressure from each fluid chamber of the fluid chambers 302-314 to its adjacent anti-cogging passage of the anti-cogging passages 800-812, respectively.

Whether the anti-cogging passages 700-712 or the anti-cogging passages 800-812 or both are used, they can communicate fluid to the grooves (e.g., the grooves 318*a*-318*g* or the semi-circular grooves 602) disposed in the stator 146 from the fluid chambers 302-314 adjacent each roller of the rollers 154. As such, high pressure fluid can be communicated to the grooves to apply the radially-inward force described above on at least a subset of the rollers 154 during rotation of the rotor 148 of the geroller hydraulic motor 100.

Figure 9:
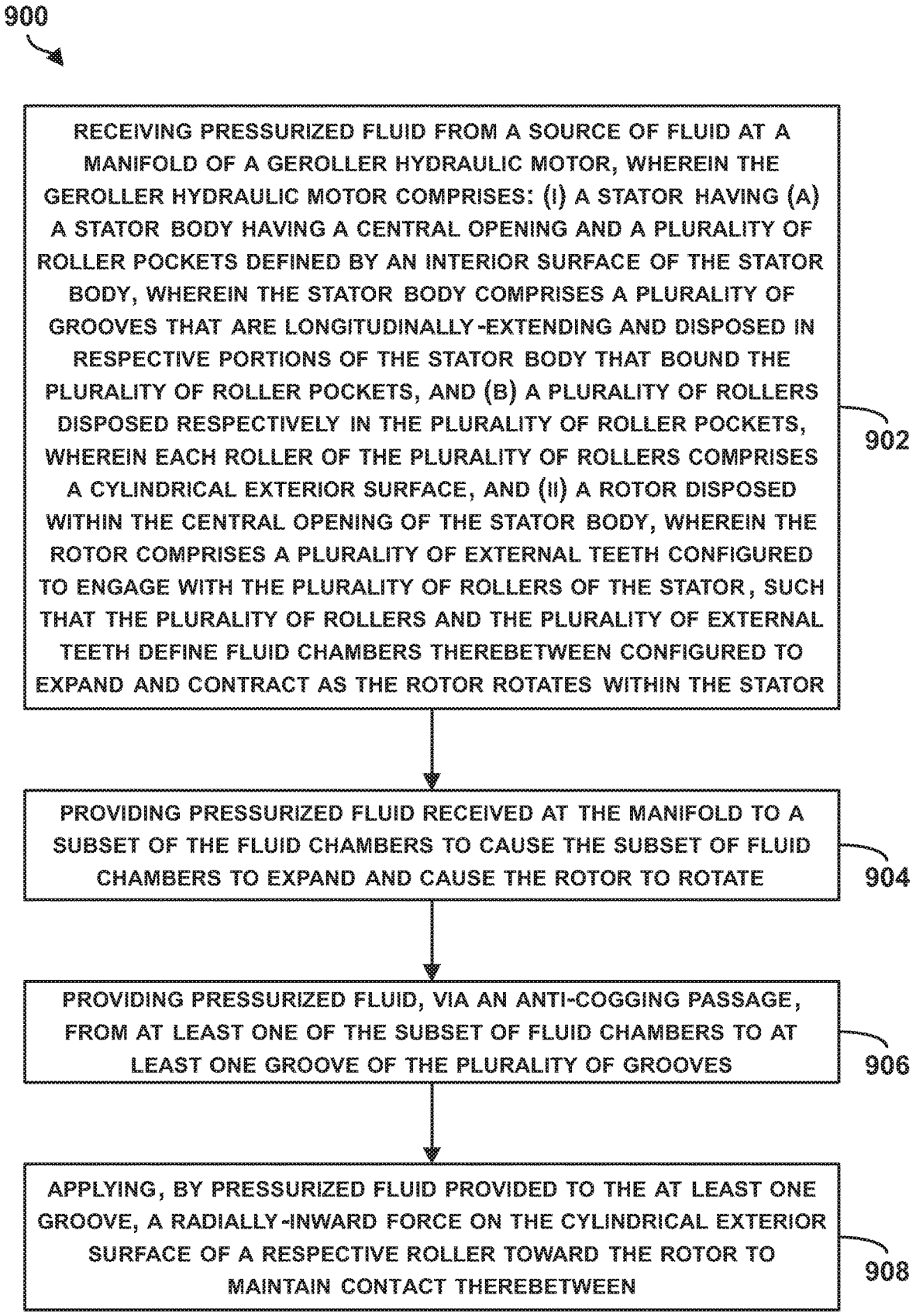
FIG. 9 is a flowchart of a method for operating a geroller hydraulic motor, in accordance with an example implementation.

FIG. 9 is a flowchart of a method 900 for operating the geroller hydraulic motor 100, in accordance with an example implementation.

The method 900 may include one or more operations, functions, or actions as illustrated by one or more of blocks 902-908. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 902, the method 900 includes receiving pressurized fluid from a source of fluid at a manifold of a geroller hydraulic motor, wherein the geroller hydraulic motor comprises: (i) a stator having (a) a stator body having a central opening and a plurality of roller pockets defined by an interior surface of the stator body, wherein the stator body comprises a plurality of grooves that are longitudinally-extending and disposed in respective portions of the stator body that bound the plurality of roller pockets, and (b) a plurality of rollers disposed respectively in the plurality of roller pockets, wherein each roller of the plurality of rollers comprises a cylindrical exterior surface, and (ii) a rotor disposed within the central opening of the stator body, wherein the rotor comprises a plurality of external teeth configured to engage with the plurality of rollers of the stator, such that the plurality of rollers and the plurality of external teeth define fluid chambers therebetween configured to expand and contract as the rotor rotates within the stator.

At block 904, the method 900 includes providing pressurized fluid received at the manifold to a subset of the fluid chambers to cause the subset of fluid chambers to expand and cause the rotor to rotate.

At block 906, the method 900 includes providing pressurized fluid, via an anti-cogging passage, from at least one of the subset of fluid chambers to at least one groove of the plurality of grooves.

At block 908, the method 900 includes applying, by pressurized fluid provided to the at least one groove, a radially-inward force on the cylindrical exterior surface of a respective roller toward the rotor to maintain contact therebetween.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A hydraulic motor comprising:

a stator comprising (i) a stator body having a central opening and a plurality of roller pockets defined by an interior surface of the stator body, wherein the stator body comprises a plurality of grooves that are longitudinally-extending, and (ii) a plurality of rollers disposed respectively in the plurality of roller pockets, wherein each roller of the plurality of rollers comprises a cylindrical exterior surface;

a rotor disposed within the central opening of the stator body, wherein the rotor comprises a plurality of external teeth configured to engage with the plurality of rollers of the stator, such that the plurality of rollers and the plurality of external teeth define fluid chambers therebetween configured to expand and contract as the rotor rotates within the stator; and an anti-cogging passage configured to provide pressurized fluid from at least one of the fluid chambers to at least one groove of the plurality of grooves of the stator body, such that pressurized fluid provided to the at least one groove applies a radially-inward force on the cylindrical exterior surface of a respective roller toward the rotor, thereby reducing a likelihood of occurrence of a tip gap between the respective roller and the rotor.

2. The hydraulic motor of claim 1, wherein the anti-cogging passage is one anti-cogging passage of a plurality of anti-cogging passages, each anti-cogging passage being configured to provide pressurized fluid from a respective fluid chamber of the fluid chambers to a corresponding groove of the plurality of grooves.

3. The hydraulic motor of claim 1, further comprising:

a manifold interfacing with the stator and the rotor, wherein the manifold comprises a plurality of fluid flow passages configured to communicate pressurized fluid from a source of fluid to the fluid chambers, wherein the anti-cogging passage is disposed in the manifold and fluidly couples a fluid flow passage of the plurality of fluid flow passages of the manifold to the at least one groove of the plurality of grooves of the stator body.

4. The hydraulic motor of claim 1, further comprising:

a wear plate interfacing with the stator and the rotor, wherein the wear plate comprises a plurality of supply passages configured to respectively receive pressurized fluid from the fluid chambers, wherein the anti-cogging passage is disposed in the wear plate and fluidly couples a supply passage of the plurality of supply passages to the at least one groove of the plurality of grooves.

5. The hydraulic motor of claim 1, wherein the at least one groove of the plurality of grooves comprises a straight groove and a slot.

6. The hydraulic motor of claim 1, wherein the at least one groove of the plurality of grooves comprises a semi-circular groove.

7. The hydraulic motor of claim 1, wherein the stator has a first longitudinal axis, and the rotor comprises a second longitudinal axis parallel to and radially-offset from the first longitudinal axis, and wherein a number of external teeth of the rotor is less than a number of rollers of the plurality of rollers such that the rotor orbits within the stator as the rotor rotates therein.

8. The hydraulic motor of claim 1, wherein the fluid chambers are separated from one another by an effective moving contact between the external teeth of the rotor and the plurality of rollers, such that a fluid chamber on one side of the effective moving contact receives fluid having a higher pressure level than a respective fluid chamber on other side of the effective moving contact.

9. A rotor set assembly of a hydraulic motor, the rotor set assembly comprising:

a stator comprising (i) a stator body having a central opening and a plurality of roller pockets defined by an interior surface of the stator body, and (ii) a plurality of rollers disposed respectively in the plurality of roller pockets, wherein each roller of the plurality of rollers comprises a cylindrical exterior surface;

a plurality of grooves that are longitudinally-extending and disposed in respective portions of the stator body that bound the plurality of roller pockets; and a rotor disposed within the central opening of the stator body, wherein the rotor comprises a plurality of external teeth configured to engage with the plurality of rollers of the stator, such that the plurality of rollers and the plurality of external teeth define fluid chambers therebetween configured to expand and contract as the rotor rotates within the stator, wherein, as the rotor rotates within the stator, at least one groove receives pressurized fluid from a fluid chamber of the fluid chambers, and the pressurized fluid in the at least one groove applies a radially-inward force on the cylindrical exterior surface of a respective roller of the plurality of rollers toward the rotor so as to maintain contact between the respective roller and the rotor and reduce a likelihood of occurrence of a tip gap between the respective roller and the rotor.

10. The rotor set assembly of claim 9, wherein the at least one groove of the plurality of grooves comprises a straight groove and a slot.

11. The rotor set assembly of claim 9, wherein the at least one groove of the plurality of grooves comprises a semi-circular groove.

12. The rotor set assembly of claim 9, wherein the stator has a first longitudinal axis, and the rotor comprises a second longitudinal axis parallel to and radially-offset from the first longitudinal axis, and wherein a number of external teeth of the rotor is less than a number of rollers of the plurality of rollers such that the rotor orbits within the stator as the rotor rotates therein.

13. The rotor set assembly of claim 9, wherein the fluid chambers are separated from one another by effective moving contact between the external teeth of the rotor and the plurality of rollers, such that a fluid chamber on one side of the effective moving contact receives fluid having a higher pressure level than a respective fluid chamber on other side of the effective moving contact.

14. A hydraulic transmission comprising:

a pump configured to provide pressurized fluid; and a geroller hydraulic motor fluidly coupled to the pump and configured to receive pressurized fluid therefrom and provide return fluid thereto, wherein the geroller hydraulic motor comprises:

a stator comprising (i) a stator body having a central opening and a plurality of roller pockets defined by an interior surface of the stator body, wherein the stator body comprises a plurality of grooves that are longitudinally-extending and disposed in respective portions of the stator body that bound the plurality of roller pockets, and (ii) a plurality of rollers disposed respectively in the plurality of roller pockets, wherein each roller of the plurality of rollers comprises a cylindrical exterior surface, a rotor disposed within the central opening of the stator body, wherein the rotor comprises a plurality of external teeth configured to engage with the plurality of rollers of the stator, such that the plurality of rollers and the plurality of external teeth define fluid chambers therebetween, wherein, as the rotor rotates within the stator, a first subset of fluid chambers are configured to expand as the first subset of fluid chambers receive pressurized fluid from the pump, whereas a second subset of fluid chambers are configured to contract as the return fluid exits the second subset of fluid chambers, and an anti-cogging passage configured to provide pressurized fluid from at least one of the first subset of fluid chambers to at least one groove of the plurality of grooves, such that pressurized fluid provided to the at least one groove applies a radially-inward force on the cylindrical exterior surface of a respective roller toward the rotor, thereby reducing a likelihood of occurrence of a tip gap between the respective roller and the rotor.

15. The hydraulic transmission of claim 14, wherein the anti-cogging passage is one anti-cogging passage of a plurality of anti-cogging passages, each anti-cogging passage being configured to provide pressurized fluid from a respective fluid chamber of the fluid chambers to a corresponding groove of the plurality of grooves.

16. The hydraulic transmission of claim 14, wherein the geroller hydraulic motor further comprises:

a manifold interfacing with the stator and the rotor, wherein the manifold comprises a plurality of fluid flow passages configured to communicate pressurized fluid received from the pump to the fluid chambers, wherein the anti-cogging passage is disposed in the manifold and fluidly couples a fluid flow passage of the plurality of fluid flow passages to the at least one groove of the plurality of grooves.

17. The hydraulic transmission of claim 14, wherein the geroller hydraulic motor further comprises:

a wear plate interfacing with the stator and the rotor, wherein the wear plate comprises a plurality of supply passages configured to respectively receive pressurized fluid from the fluid chambers, wherein the anti-cogging passage is disposed in the wear plate and fluidly couples a supply passage of the plurality of supply passages to the at least one groove of the plurality of grooves.

18. The hydraulic transmission of claim 14, wherein the at least one groove of the plurality of grooves comprises a straight groove and a slot.

19. The hydraulic transmission of claim 14, wherein the at least one groove of the plurality of grooves comprises a semi-circular groove.

20. The hydraulic transmission of claim 14, wherein the stator has a first longitudinal axis, and the rotor comprises a second longitudinal axis parallel to and radially-offset from the first longitudinal axis, and wherein a number of external teeth of the rotor is less than a number of rollers of the plurality of rollers such that the rotor orbits within the stator as the rotor rotates therein, and wherein the fluid chambers are separated from one another by effective moving contact between the external teeth of the rotor and the plurality of rollers, such that a fluid chamber on one side of the effective moving contact receives fluid having a higher pressure level than a respective fluid chamber on other side of the effective moving contact.

* * * * *